US006779581B2

(12) United States Patent
Towley

(10) Patent No.: US 6,779,581 B2
(45) Date of Patent: Aug. 24, 2004

(54) SECONDARY PHYSICAL/VISUAL BARRIER

(76) Inventor: Louis Towley, 306 Coronado Dr., Aptos, CA (US) 95003

( * ) Notice: Subject to any disclaimer, the term of this patent is extended or adjusted under 35 U.S.C. 154(b) by 0 days.

(21) Appl. No.: 10/205,779

(22) Filed: Jul. 25, 2002

(65) Prior Publication Data

US 2004/0016515 A1 Jan. 29, 2004

(51) Int. Cl.[7] ..... E06B 3/32
(52) U.S. Cl. ..... 160/98; 49/68
(58) Field of Search ..... 160/98, 107, 95, 160/96, 90; 49/54, 56, 66, 65, 68, 103

(56) References Cited

U.S. PATENT DOCUMENTS 1,997,846 A * 4/1935 Armstrong ..... 160/23.1
4,493,164 A * 1/1985 Wagner ..... 49/65
5,649,396 A * 7/1997 Carr ..... 52/174
6,279,276 B1 * 8/2001 Knoll ..... 52/173.2

* cited by examiner

*Primary Examiner*—Blair M. Johnson
(74) *Attorney, Agent, or Firm*—Donald R. Boys; Central Coast Patent Agency, Inc

(57) ABSTRACT

A physical barrier system for barring entry for a vehicle having a clearance height through a door opening having a roll-up door has a physical barrier positionable in a first position visible to a driver of the vehicle and at least partially barring passage by the vehicle through the door opening, and in a second position not barring passage by the vehicle through the door opening, and a mechanism for moving the physical barrier from the first position to the second position. The system is characterized in that the mechanism for moving the physical barrier is initiated at a point at which the roll-up door has attained a height equal to or greater than the clearance height of the vehicle.

8 Claims, 4 Drawing Sheets

SECONDARY PHYSICAL/VISUAL BARRIER

FIELD OF THE INVENTION

Figure 1:
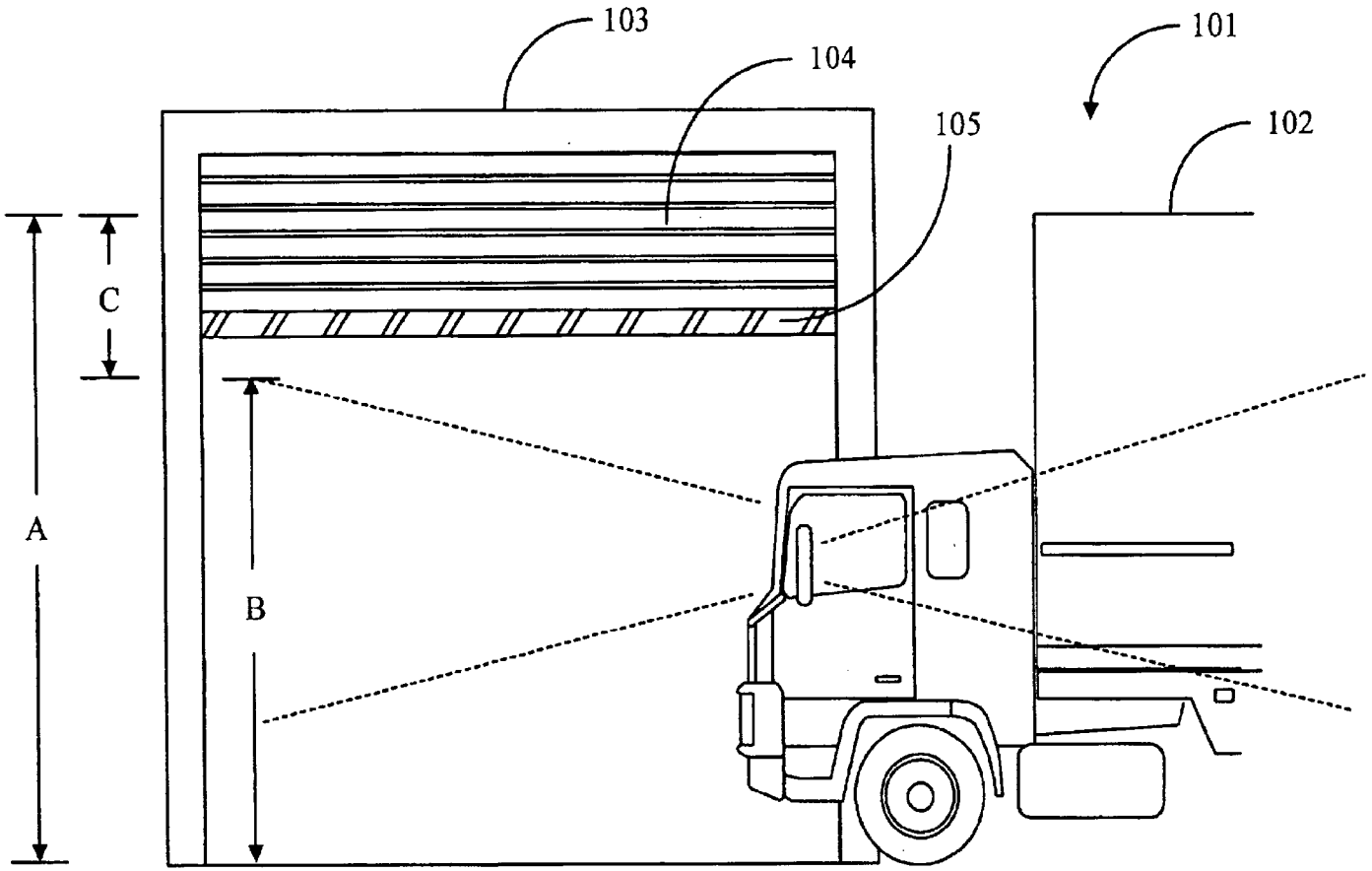
Fig. 1 (Prior Art)

The present invention is in the area of physical aids for vehicle drivers, and pertains more particularly to a visual and physical barrier for indicating complete operation of a roll-up door.

BACKGROUND OF THE INVENTION

There exist in the world a great number of powered roll-up doors on such as warehouses, garages, and many other sorts of buildings. These doors take many forms, such as single-panel doors as often seen for garages at residences, multiple panel doors, and flexible doors. Generally all such doors have followers of some sort that follow a guiding track as the door is raised or lowered, and typically the doors are powered, usually by electric motors, but may be manually operated as well. For purposes of this specification all such doors are included, and will be referred to as roll-up doors.

It is unfortunately a rather common occurrence that a truck driver, having pulled up to a roll-up door, and having activated the mechanism to cause the door to open, pulls ahead to drive through the door before it is fully raised, and considerable damage may result. In some cases, too, the door may stick or otherwise malfunction before it is fully raised, but after it is no longer in the limited sight of the driver, with the same end result.

There are in the art various systems for indicating to a driver that the door is fully open, such as an audible signal or a visible light activated when the door is fully open. There are also in the art breakaway systems such that a portion of a door rammed by a vehicle will break away rather than destroying the entire door and expensive drive mechanisms. In many cases, however, these systems malfunction, don't work at all (burned out bulb for example), or are for some reason ignored by the driver. What is needed is a system that imposes a visible, physical barrier to the driver until the door is raised to a point that the vehicle can safely pass. Such a system is described in enabling detail below.

SUMMARY OF THE INVENTION

In a preferred embodiment of the present invention a system for barring entry for a vehicle having a clearance height through a door opening having a roll-up door is provided, comprising a physical barrier positionable in a first position visible to a driver of the vehicle and at least partially barring passage by the vehicle through the door opening, and in a second position not barring passage by the vehicle through the door opening, and a mechanism for moving the physical barrier from the first position to the second position. The system is characterized in that operation of the mechanism for moving the physical barrier from the first position to the second position is initiated at a point at which the roll-up door has attained a height equal to or greater than the clearance height of the vehicle.

In a preferred embodiment the physical barrier is a cantilevered bar pivoted about a pivot point at one edge of the door opening. Also in a preferred embodiment the mechanism for moving the bar comprises a linkage coupled to the bar, the linkage having an engagement element for engaging the roll-up door at the point where the roll-up door has attained a height equal to or greater than the clearance height of the vehicle.

In some embodiments a second engagement element is mounted to the roll-up door to engage the first engagement element on the linkage. Also in some embodiments graphic indicia and/or text may be placed on the physical barrier.

In another aspect of the invention a method for indicating full opening of a roll-up door to a driver of a vehicle is provided, comprising the steps of (a) mounting a physical barrier positionable in a first position visible to the driver and at least partially barring passage by the vehicle, and in a second position not barring passage by the vehicle; and (b) coupling a mechanism for moving the physical barrier from the first position to the second position to the physical barrier, in a manner that the mechanism is initiated to move the barrier from the first position to the second position at a point at which the roll-up door has attained a height equal to or greater than the clearance height of the vehicle.

In some preferred embodiments of the method the physical barrier is a cantilevered bar pivoted about a pivot point at one edge of an opening served by the roll-up door. Also in some preferred embodiments the mechanism for moving the bar comprises a linkage coupled to the bar, the linkage having an engagement element for engaging the roll-up door at the point where the roll-up door has attained a height equal to or greater than the clearance height of the vehicle.

In some embodiments a second engagement element is mounted to the roll-up door to engage the first engagement element on the linkage. Also in some embodiments graphic indicia and/or text is added to the physical barrier.

BRIEF DESCRIPTION OF THE DRAWING FIGURES

FIG. 1 is an elevation view of a conventional roll-up door and a trucking vehicle.

Figure 2A:
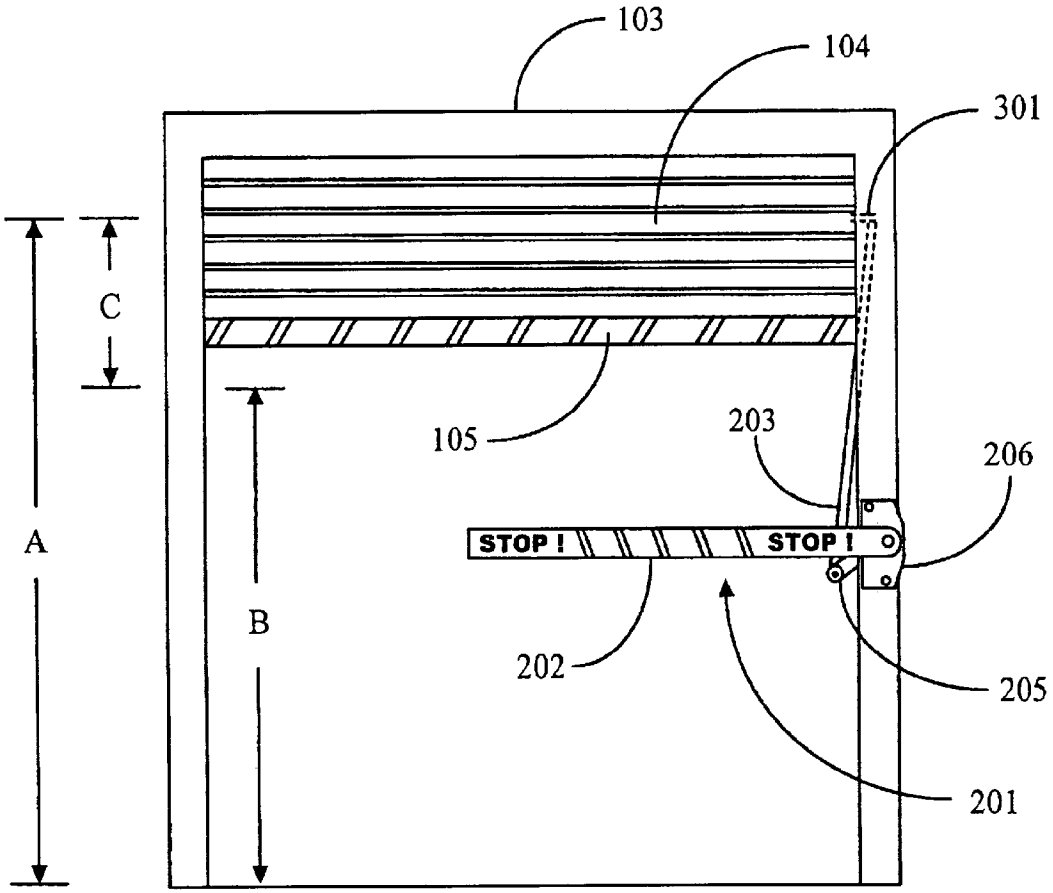

FIG. 2*a* is an elevation view of the roll-up door of FIG. 1 with a secondary physical/visual barrier according to an embodiment of the present invention.

Figure 2B:
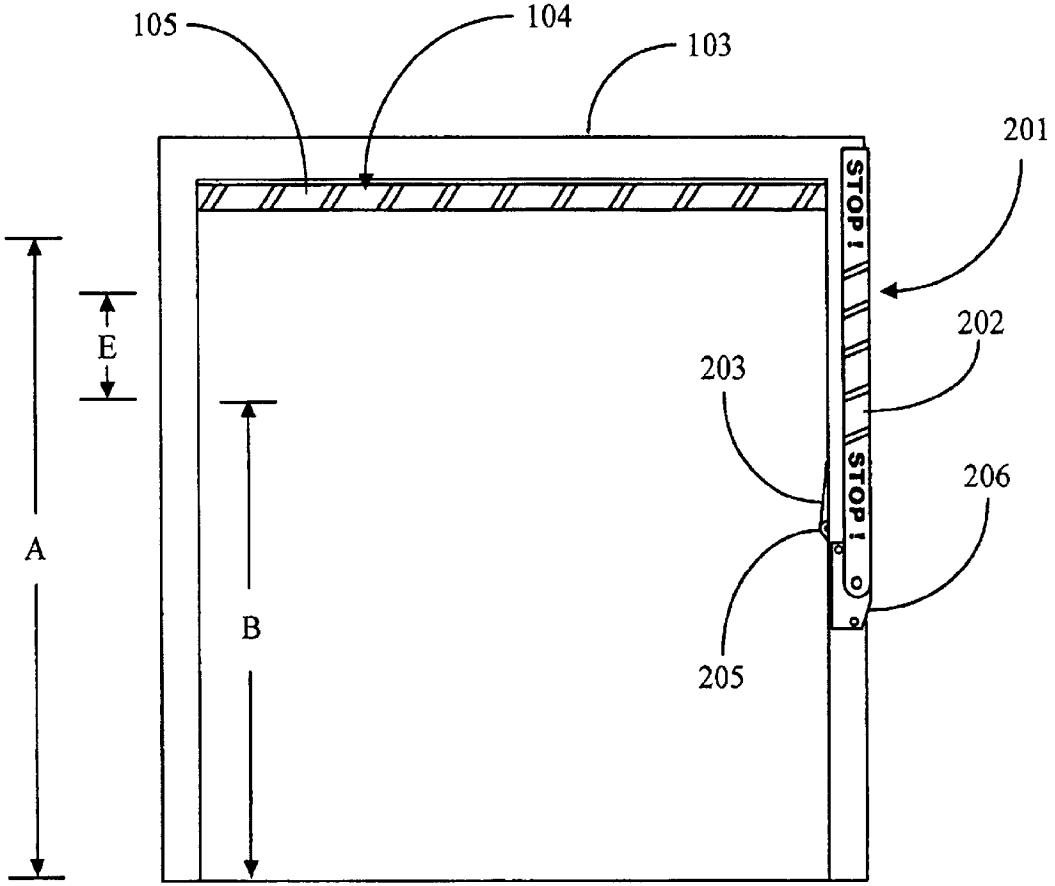

FIG. 2*b* is an elevation view of the roll-up door and secondary barrier of FIG. 2*a* in the raised position according to an embodiment of the present invention.

Figure 3:
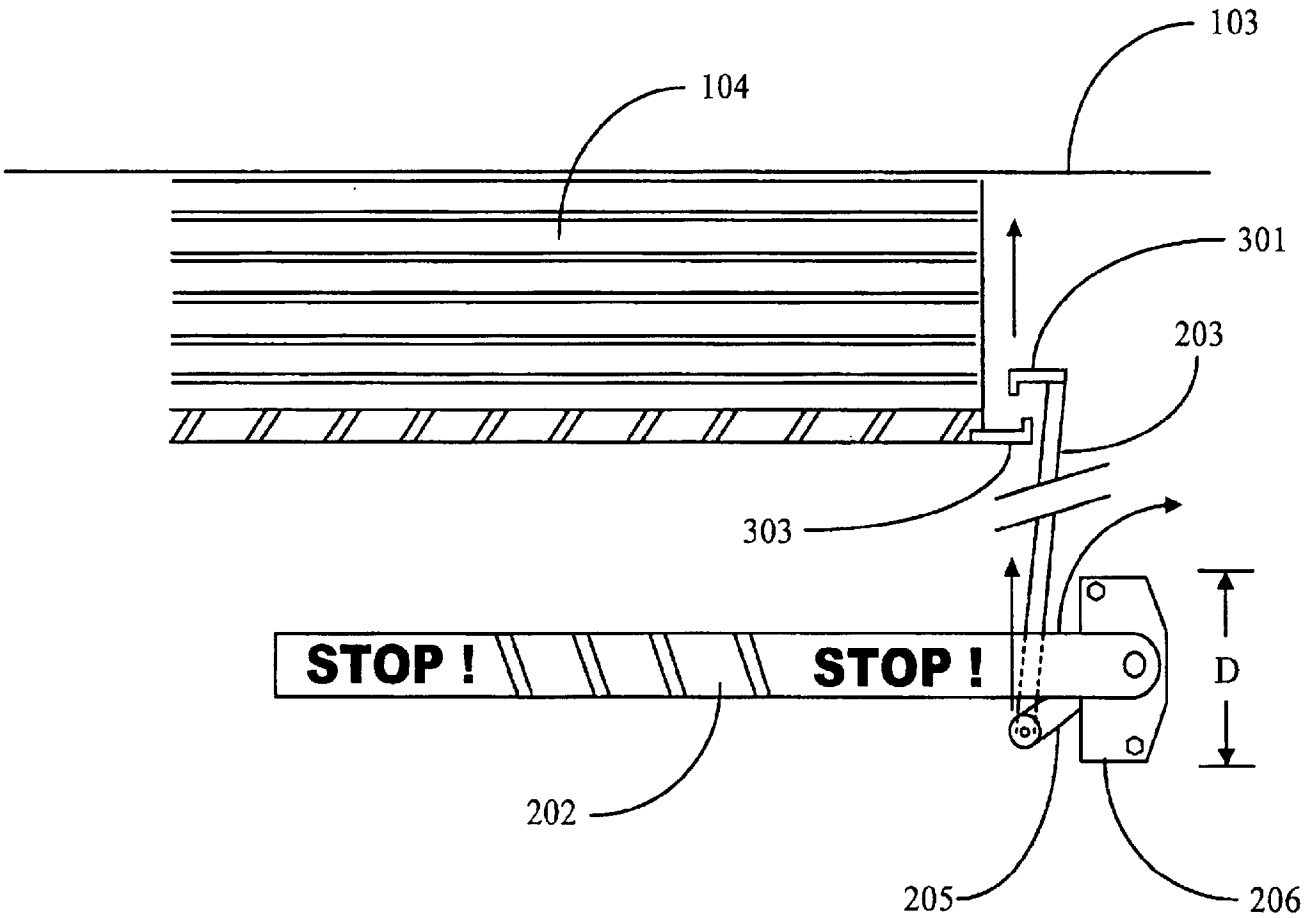

FIG. 3 is an elevation view of the roll-up door and secondary barrier of FIG. 2*a*, enlarged to show greater detail.

DESCRIPTION OF THE PREFERRED EMBODIMENTS

FIG. 1 is an elevation view of a conventional roll-up door and a trucking vehicle. For purposes of illustration the example shown in FIG. 1 describes a roll-up door for covering the shipping/receiving opening in an industrial building, the roll-up door utilizing conventional mounting and operating hardware and apparatus for lowering and raising the roll-up door according to conventional art, and a trucking vehicle having the intention of passing through the shipping/receiving opening in the building in order to make a delivery or pickup. It should be understood, however, that the present invention is not limited to a particular type of building or structure, opening in the door structure, or any particular type of retractable door or delivery vehicle, as is shown in the prior art example of FIG. 1, or subsequent illustrations herein describing embodiments of the present invention. It is an object of the present invention to provide a secondary physical/visual barrier which is always visible to the driver, and indicated by its raised or lowered position, alerts the driver of a vehicle wishing to gain passage through an opening in a building, for example, that the retractable door which covers the opening in the building is or is not safely out of the path of the incoming or outgoing vehicle.

The present invention may be practiced in conjunction with the operation of many different types of retractable doors, referred to herein in general as roll-up doors, used with many different types of buildings or structures having varying door opening shapes or dimensions, and is provided for easily attaching to, or near the frame of the opening of the building or structure, regardless of the type of building or structure.

FIG. 1 illustrates a conventional shipping/receiving door opening 103 of an industrial building. Roll-up door 104 is a conventional metal roll-up door utilizing conventional mounting and operating hardware and apparatus for lowering and raising the door within the framed opening 103. As described above however, the roll-up door may be of a variety of types and sizes in different embodiments of the present invention, such as a wooden or metal sectional door, a solid, retractable door, such as that used for a home garage opening, and so on without departing from the scope and spirit of the invention. The inventor has chosen to illustrate the conventional metal roll-up door in an industrial building as shown in FIG. 1, for practicing the present invention, only for simplification of illustration and description in the current application.

Metal roll-up door 104 has a visually pronounced safety bar 105 spanning the width of door 104 located at the bottom edge of door 104. Safety bar 105 is conventionally used in applications such as are described herein to provide a pronounced visual indicator to the driver of a vehicle entering or exiting opening 103, of the location of the bottom edge of door 104. Safety bar 105, however, provides the driver with such visual indication of the door's position within the opening 103, only when the position of door 104 is such that safety bar 105 remains within the driver's field of vision while sitting in the driver's compartment of the vehicle, or within the drivers field of vision as provided by the rear view mirror of the vehicle.

Truck 101 is a typical delivery vehicle having a rear cargo box 102, which is of a substantial height as compared with a typical passenger car, for example. Dimension A, as illustrated in FIG. 1, represents the vertical height of cargo box 102 of truck 101. Opening 103, as with the openings of most typical industrial buildings wherein shipping and receiving takes place by delivery vehicle, is of a predetermined height which is slightly higher than, and therefore accommodates, the vertical height of the vast majority of commercial delivery vehicles, dimension A being slightly less in height then the vertical height of opening 103.

As mentioned above, the effectiveness of safety bar 105 in providing the driver of vehicle 101 a visual indicator of the position of door 104, is determined by whether or not safety bar 105 is within the driver's field of vision as provided by either the front windshield or the rear view mirror, while the driver is sitting within the driver's compartment of vehicle 101 and attempting to drive forward through opening 103, or back into opening 103 in the reverse direction.

Dimension B of FIG. 1 represents the upper limit of the field of vision of the seated driver of truck 101, whether through the front windshield of 101, or through the rear view mirror. It may be assumed that in actual practice the upper limit of the drivers' field of vision, represented by dimension B, may differ depending on whether the field of vision is provided by the front windshield or by the rear view mirror. However, for purposes of simplifying illustration, dimension B is chosen to represent the limit of both the front and a rear fields of vision for the driver of truck 101.

As is clearly shown in the simplified illustration of FIG. 1, in order for truck 101 to safely pass through opening 103 without causing damage to door 104, door 104 must be a raised to a height such that the bottom edge of safety bar 105, which is attached to the lower edge of door 104, is at least slightly higher than the top edge of cargo box 102 of truck 101. However, if the position of door 104 is such that safety bar 105 is above and out of the driver's field of vision as provided from within the cab of the vehicle, but door 104 still has not yet been raised to a point such that clearance would be provided to cargo box 102 for passing through opening 103, the driver may assume that since the visual indicator provided by safety bar 105 is out of his or her field of vision, that sufficient clearance exists for safe passage through opening 103. In the instance where roll-up door 104 is being raised to accommodate truck 101 to a point where safety bar 105, traveling upwards, leaves the driver's field of vision, but has not yet been raised sufficiently to provide clearance for the top edge of cargo box 102 of truck 101, the driver may very likely be unaware that sufficient clearance does not yet exist because safety bar 105 is out of the drivers field of vision but has not yet been raised sufficiently to provide the required clearance for cargo box 102.

Dimension C of FIG. 1 represents the distance door 104 must travel upwardly after safety bar 105 leaves the driver's field of vision, before sufficient clearance is provided in opening 103 for passage of truck 101. It is quite conceivable that in practice, depending on the height of opening 103, the speed at which truck 101 is entering opening 103, and the speed at which door 104 is traveling upward during opening, a substantial amount of time, potentially 5–10 seconds or more in many cases, may pass between the time that safety bar 105 leaves the upper limit of the driver's field of vision and the time at which the bottom edge of safety bar 105 is raised sufficiently to provide the required clearance for cargo box 102, as indicated by dimension C. During the matter of several seconds or more which may pass, it may easily appear to the driver of truck 101, when assessing the amount of clearance while entering opening 103, that door 104 is raised sufficiently for clearance, and while pulling forward into or backing into opening 103, the driver may be unaware that such clearance still does not yet exist because door 104 has not traveled the entire distance of dimension C, thereby raising the likelihood that the driver may potentially strike and damage door 104 with cargo box 102.

FIG. 2*a* is an elevation view of the roll-up door and opening of FIG. 1 with a secondary physical/visual barrier in a first lowered position according to an embodiment of the present invention. In this view opening 103 and conventional metal roll-up door 104 of FIG. 1 are shown for the purpose of illustrating a preferred embodiment of the present invention. Barrier 201 is provided for giving the driver of a vehicle wishing to pass through opening 103 a clear and obvious visual indicator and physical barrier, enabling the driver of the vehicle to ascertain quickly and without question whether or not metal roll-up door is in a current position for providing clearance for passage of the vehicle through opening 103.

Barrier 201 in this example comprises an elongated stop bar 202 for providing a physical barrier as well as a clear visual indicator that, when stop bar 202 is in its lowered position as illustrated in FIG. 2*a*, there is currently not sufficient clearance between the bottom surface of safety bar 105 of door 104, and the ground, for providing passage of the vehicle through opening 103. In a preferred embodiment stop bar 202 may be graphically designed on either side providing visual prominence and/or readable warnings to further stand out in the driver's forward or rear field of vision. Such visual indicia may be permanent, or made to change such as color or text depending on the position of the barrier. Stop bar 202 in this example is of substantial length, such that when in the lowered position as shown, a substantial portion of the width of opening 103 is spanned by, and protected by the length of stop bar 202.

It is emphasized again that the embodiment described is an example, and the invention may take many other forms. For example, a mechanism similar to that shown may be implemented from both sides of a wide doorway to span more of the doorway. Barriers may also take other forms than the bar shown, and bar type barriers may be hinged and the like for various reasons.

Stop bar 202 in this example is pivotally attached at one end to a mounting apparatus 206 such that stop bar 202 may rotate from the shown lowered horizontal position, rotating on the pivot at mount 206 to a vertically oriented position which provides clearance in opening 103 for the passing vehicle. In a preferred embodiment mount 206 is fixedly attached to, or near, the framing of opening 103, on one side or the other of opening 103 and either on the exterior or the interior of the building or structure, depending on the application, utilizing standard and well-known fastening methods, such as screws or bolts. Mount 206 is positioned on the side of opening 103 at a height such that, when stop bar 202 is in its lowered position as shown, stop bar 202 is nearly centered in the driver's front or rear field of vision, providing optimal visual prominence to the driver of the vehicle wishing to pass through opening 103.

In the embodiment shown in FIG. 2*a*, an actuator lever 205 is pivotally attached at mount 206 similarly to stop bar 202, but is attached on the surface of mount 206 opposite from that which stop bar 202 is mounted, and on the opposite side of the framing of opening 103, or the wall of the building or structure into which opening 103 is incorporated. In alternative embodiments however lever 205 may be pivotally attached on the same surface of mount 206 as is used for the mounting of stop bar 202, as it is not necessary for operation of the present invention for the mounting of stop bar 202 and lever 205 to be on opposite sides of the framing of or wall of opening 103.

A rotating pivot interface (not shown) passes through mount 206 and also through the framing of opening 103, and has the purpose of fixedly and rotatably connecting, at the pivot point of mount 206, stop bar 202 to lever 205, such that, upon the rotation of lever 205, stop bar 202 rotates in the same direction.

One end of lever 205 is pivotally connected to the end of an actuator bar 203, actuator bar 203 extending upward towards the top of opening 103, to a point just below the upper limit of dimension C, which indicates the minimal safe position for the bottom surface of safety bar 105 for providing clearance for the entering or exiting delivery vehicle. At the upper end of actuator bar 203 a hook 301 is provided which extends inward in this embodiment from the outer edge of opening 103, towards the interior of opening 103, such that when door 104 is raised to the upper limit of dimension C, an engaging apparatus (not shown) attached to the bottom of door 104 engages hook 301 of actuator bar 203, and through the pivoting linkages as described above between actuator bar 203, lever 205 and stop bar 202, stop bar 202 is thereby rotated from the shown horizontal position, 90 degrees to an upright vertical position, indicating to the driver of the vehicle that sufficient clearance exists between the floor and the bottom of door 104. Some enabling details as described above for mount 206, actuator bar 203, and hook 301 of actuator bar 203, bar are not shown in the illustrations so far described for reasons of simplifying illustration.

FIG. 2*b* is an elevation view of the roll-up door and secondary barrier of FIG. 2*a* in the raised position according to an embodiment of the present invention. Roll-up door 104 has been nearly fully retracted into opening 103, such that only the lower safety bar 105 of door 104 is now substantially above the upper limit of the field of vision of a driver of a vehicle, indicated by dimension B. Door 104, retracted to this position, provides more than necessary clearance for delivery vehicles of standard height, indicated by dimension A, for passage through opening 103.

Barrier 201 is shown now in its retracted vertical position pivotally attached to mount 206, portions of lever 205 and actuator bar 203, in their upward position, visible behind stop bar 201 and the framing of opening 103. In a preferred embodiment, door 104 which has an engaging apparatus at the lower corner, as described with reference to FIG. 2*a* above, engages hook 301 (not shown) of actuator bar 203 when door 104 is nearly in the fully retracted position, but not until it has reached a position as indicated by the upper limit of dimension E. In this embodiment the distance between the upper limit of dimension E and the bottom of door 104 is roughly equal to the distance between the upper and lower limits of travel of the end of lever 205 where it is attached to actuator bar 203, when stop bar 202 is rotated from a horizontal position 90 degrees to a vertical position. In this manner, once safety bar 105 of the upward traveling door 104 has left the upper limit of the driver's field of vision, indicated by dimension B, door 104 must still continue to travel the distance of dimension E before engaging hook 301 (not shown) of actuator bar 203, which thereby rotates stop bar 202 to its vertical position.

As previously described with reference to FIG. 1, once the bottom of door 104, while door 104 is retracted into opening 103, has left the upper limit of the driver's field of vision, several seconds, in some cases 5–10 seconds, may elapse before door 104 travels upward the entire distance of dimension E. Such a time delay allows the actuation of barrier 201 to be delayed for that period of time after door 104 leaves the driver's field of vision, leaving stop bar 202 in its horizontal position, or safety position, as shown in FIG. 2*a*, until door 104 is nearly fully retracted, or reaches the upper limit of dimension E.

FIG. 3 is an elevation view of the roll-up door and secondary barrier of FIG. 2*a*, enlarged to show greater detail. Operation of actuator bar 203 and stop bar 202 is better illustrated in this enlarged view. Lever 205 in this embodiment is of a length substantially shorter than stop bar 202 and actuator rod 203, as can be clearly seen in this view. Actuator bar 203 is seen pivotally connected to the end of lever 205.

Door 104 is shown having an engaging apparatus, illustrated as hook 303 in this view, positioned at the lower corner of door 104 on the same side of door 104 as actuator bar 203. In operation in this example, as door 104 is raised towards the upper limit of opening 103 as shown, hook 303 of door 104 engages hook 301 of actuator bar 203, thereby lifting actuator bar 203 which in turn actuates lever 205, rotating stop bar 202 in the same direction via the connecting axle (not shown). It is noted that, in order to fully rotate stop bar 202 from the lowered position shown, to a second position that does not bar entry, the vertical distance of the rotation of lever 205 needs be a relatively short distance, as indicated by dimension D, in this embodiment approximately six inches, due to the substantially short length of lever 205. The benefit is, as described above, that door 104 must be nearly fully retracted (raised) before engaging hook 301, and subsequently actuating stop bar 202 from the horizontal to the vertical position, as described above.

It will be apparent to the skilled artisan that hooks 303 and 301 may be rotated ninety degrees from the orientation shown, and that a number of other changes may also be made within the spirit and scope of the invention. Hook 301 may simply engage the bottom edge of the door, rather than there being a separate element for engaging hook 301, for example.

Such a barrier device as described herein is oriented at the opening of the building or structure in such a way that the blind spot in the driver's field of vision, which occurs when the roll-up or other type of door travels above and out of the driver's field of vision, but before retracting sufficiently to provide ample clearance for the vehicle wishing to pass thorough the opening, is eliminated by the visual and physical prominence of the barrier system which is not retracted until the door is nearly open. Such a system significantly reduces the possibility of physical damage to the door, to the vehicle itself, and the coincidental monetary damages for repairs to the door, building or structure and vehicle, as well as business disruption due to the loss of the use and operation of the opening to the building or structure.

It will be apparent to one with ordinary skill in the art that many changes may be incorporated into the embodiments taught in enabling detail above, without departing from the spirit and scope of the invention. For example, barrier 201 may be positioned at the opening of the building or structure either on the interior or exterior of the building, and at varying locations depending upon the dimensions of the opening, or varying effects on the driver's field of vision, such as sloped loading ramps, elevated docks, and so on. Embodiments of the invention are useful as well on interior roll-up doors. Only exemplary examples of actuating, pivoting and connecting or engaging apparatus, for example, have been shown and described herein for the purpose of simplifying illustration of the operation of a preferred embodiment of the present invention utilizing said elements.

The individual elements for practicing the invention as taught herein may vary substantially by type, size, and so on without departing from the scope of the invention. It is an object of the present invention to provide a secondary physical/visual barrier that does not retract to provide clearance for passage of a vehicle through the opening in a building or structure until the roll-up or other type of door is safely out of the path of the vehicle. For these reasons the present invention should be afforded the broadest possible scope, limited only by the claims that follow.

What is claimed is:

1. A system for barring entry for a vehicle having a clearance height through a door opening having a roll-up door, comprising:

a physical barrier positionable in a first position visible to a driver of the vehicle and at least partially barring passage by the vehicle through the door opening, and in a second position not barring passage by the vehicle through the door opening; and a linkage mechanism operable by the roll-up door and including a first engagement element for engaging a portion of the roll-up door when the roll-up door is moving from a closed position to an open position, providing a mechanical advantage for moving the physical barrier from the first position to the second position.

2. The barrier system of claim 1 wherein the physical barrier is a cantilevered bar pivoted about a pivot point at one edge of the door opening.

3. The system of claim 1, wherein a second engagement element is mounted to the roll-up door to engage the first engagement element on the linkage.

4. The system of claim 1 having graphic indicia and/or text on the physical barrier.

5. A method for indicating full opening of a roll-up door to a driver of a vehicle, comprising the steps of:

(a) mounting a physical barrier positionable in a first position visible to the driver and at least partially barring passage by the vehicle, and in a second position not barring passage by the vehicle; and (b) coupling a linkage mechanism operable by the roll-up door and including a first engagement element for engaging a portion of the roll-up door, providing a mechanical advantage for moving the physical barrier from the first position to the second position to the physical barrier, in a manner that the mechanism is initiated to move the barrier from the first position to the second position at a point at which the roll-up door has attained a height equal to or greater than the clearance height of the vehicle.

6. The method of claim 5 wherein the physical barrier is a cantilevered bar pivoted about a pivot point at one edge of an opening served by the roll-up door.

7. The method of claim 5 wherein a second engagement element is mounted to the roll-up door to engage the first engagement element on the linkage.

8. The method of claim 5 wherein graphic indicia and/or text is added to the physical barrier.

* * * * *